US005495679A

United States Patent [19]

Deshpande et al.

[11] Patent Number: 5,495,679

[45] Date of Patent: Mar. 5, 1996

[54] PAPERMAKING DRYER WITH MULTI-ROLL VACUUM CHAMBER

[75] Inventors: Rajendra D. Deshpande, rockton; Jeffrey H. Pulkowski, Roscoe, both of Ill.

[73] Assignee: Beloit Technologies, Inc., Wilmington, Del.

[21] Appl. No.: 379,372

[22] Filed: Jan. 27, 1995

[51] Int. Cl.[6] ..... F26B 11/02

[52] U.S. Cl. ..... 34/117; 34/114

[58] Field of Search ..... 34/116, 117, 123

[56] References Cited

U.S. PATENT DOCUMENTS

| | | | |
|---|---|---|---|
| 3,956,832 | 5/1976 | Justus | 34/115 |
| 4,807,371 | 2/1989 | Wedel | 34/117 |
| 4,876,803 | 10/1989 | Wedel | 34/117 |
| 4,882,854 | 11/1989 | Wedel et al. | 34/115 |
| 4,967,489 | 11/1990 | Autio | 34/114 |
| 5,046,266 | 9/1991 | Autio | 34/120 |

*Primary Examiner*—Henry A. Bennett
*Assistant Examiner*—Dinnatia Doster
*Attorney, Agent, or Firm*—Dirk J. Veneman; Raymond W. Campbell; David J. Archer

[57] ABSTRACT

The dryer of this invention employs a vacuum chamber interposed below and between first and second heated dryer rolls. The vacuum chamber has two sides and a top which overlies two grooved reversing rolls. The vacuum chamber controls all flow of air in the gap between and below the dryer rolls. The dryer-fabric-backed paper web passes from the first dryer roll around the reversing rolls and up to the second dryer roll. The dryer fabric seals the vacuum chamber, and air is drawn therefrom. The provision of the grooved rolls permits a greater wrap of the felt around the dryers and the application of vacuum to hold the web against the felt during movement of the web between the dryers and the grooved rolls and between the grooved rolls.

12 Claims, 7 Drawing Sheets

PAPERMAKING DRYER WITH MULTI-ROLL VACUUM CHAMBER

FIELD OF THE INVENTION

The present invention relates to dryers in papermaking machinery in general, and to single tier dryers in particular.

BACKGROUND OF THE INVENTION

In the paper manufacturing industry, a critical factor controlling the production of a cost effective paper product is the ability to rapidly and efficiently dry the paper stock. The plant must be able to cost effectively remove water in order to produce a paper product having a workable moisture content.

Upon entering the headbox of the papermaking plant, the paper stock is released onto a rapidly moving forming wire. Excess water filters through the forming wire and the paper fibers interlace with one another thereby forming a paper mat on the forming wire or screen. The formed paper web is carried on the screen through a series of rolls which smooth out the web and press out excess water.

At the end of the forming wire, the paper web is transferred to a dryer fabric which conveys the web around a series of steam heated dryer drums. Upon contact with the heated dryer drums, excess water in the web is evaporated which reduces the moisture content in the web to the desired level.

In order to reduce operating and capital costs, paper manufacturers have steadily increased production rates. During the standard drying process, the dryer fabric and web can travel at a speed of 4,000 feet per minute. Early drying schemes utilized a row of upper drying drums aligned above a row of lower drying drums and the web was conveyed around successive drying drums in a serpentine manner. As the web was transferred from an upper drum to a successive lower drum, it passed through a gap of open draw in which the web was not in contact with the dryer fabric. This open draw presented problems at high production speeds because the unsupported web often fluttered and sometimes broke, forcing paper production to stop.

In an attempt to minimize shutdowns, a single continuous flexible support dryer design was developed. The web was supported by a single flexible dryer fabric. Although this scheme used the same upper and lower rows of drying drums, it avoided the problems associated with the open draw by having the web remain in constant contact with the dryer fabric. While this new scheme reduced web fluttering and breakage, it created two different problems. First, due to the high web and dryer fabric speeds, the rapidly moving felt causes a high pressure area at the nip where the dryer fabric and web initially contact each drying drum. This localized high pressure, combined with inertial effects, causes the web to separate from the dryer fabric causing wrinkling and, in severe cases, breakage of the web. Second, by the nature of the configuration of the single continuous support dryer design, the dryer fabric was located between the lower dryer drum surfaces and the web. Because of its interior location, the dryer fabric insulates the web from the heat of the lower drying drums, thereby reducing drying efficiency for the lower drums.

Several configurations have been designed to solve the problems associated with the single dryer fabric continuous dryers. Known configurations include replacing lower dryer drums with unheated vacuum rolls, with unheated grooved rolls, or with unheated rolls having exterior vacuum sources. These configurations prevent pressure build-up at the nip where the dryer fabric and web contact the roll surface and save energy because they are not heated. However, because the configurations have only one level of drying drums, they occupy a large floor area of the paper manufacturing facility. This problem is intensified by the fact that single rolls, due to the small angle of web wrap on the dryers, are unable to utilize the maximum surface drying area of the upper drying drums. Also, the lack of open draw space and failure of these configurations to completely control air flow in the pocket above each roll minimizes the ability of utilizing air caps as a method of increasing drying efficiency. Finally, the cost of a vacuum roll, due to the high cost of drilling a multitude of vacuum draw holes in, is approximates the cost of a full-sized heated drying drum.

What is needed is an economical paper drying apparatus that maximizes the angle of web wrap on the dryer while completely controlling air flow in the pocket above each roll, and which eliminates disruptive localized pressure at the nips and allows the use of air caps in order to increase drying efficiency.

SUMMARY OF THE INVENTION

The dryer of this invention employs a vacuum chamber interposed below and between first and second heated dryer rolls. The vacuum chamber has two sides and a top which overlies two grooved reversing rolls. The vacuum chamber controls all flow of air in the gap between and below the dryer rolls. The dryer-fabric-backed paper web passes from the first dryer roll around the reversing rolls and up to the second dryer roll. The dryer fabric seals the vacuum chamber, and air is drawn therefrom. The two rolls within the chamber permit a greater fraction of the dryer roll surfaces to be maintained in contact with the web. Furthermore, the chamber permits a vacuum to be drawn on two rolls as well as three sections of web which are not engaged with rolls by a single vacuum source for significant cost savings.

It is an object of the present invention to provide a paper drying apparatus that completely controls air flow in the pocket between successive dryers in order to eliminate flapping of the web and to enable the use of air caps in combination with high permeability dryer fabric.

It is another object of the present invention to provide a compact paper drying machine.

It is a further object of the present invention to provide a paper drying apparatus of increased efficiency which utilizes a greater fraction of dryer roll surface for paper drying.

It is an additional object of the present invention to provide a cost-effective paper drying machine which does not require vacuum rolls and which utilizes a minimal number of drying drums.

It is also an object of the present invention to provide a paper drying machine that has an area of open draw which enables the effective use of air caps in the drying process.

Further objects, features and advantages of the invention will be apparent from the following detailed description when taken in conjunction with the accompanying drawings.

DESCRIPTION OF THE PREFERRED EMBODIMENT

Figure 1:
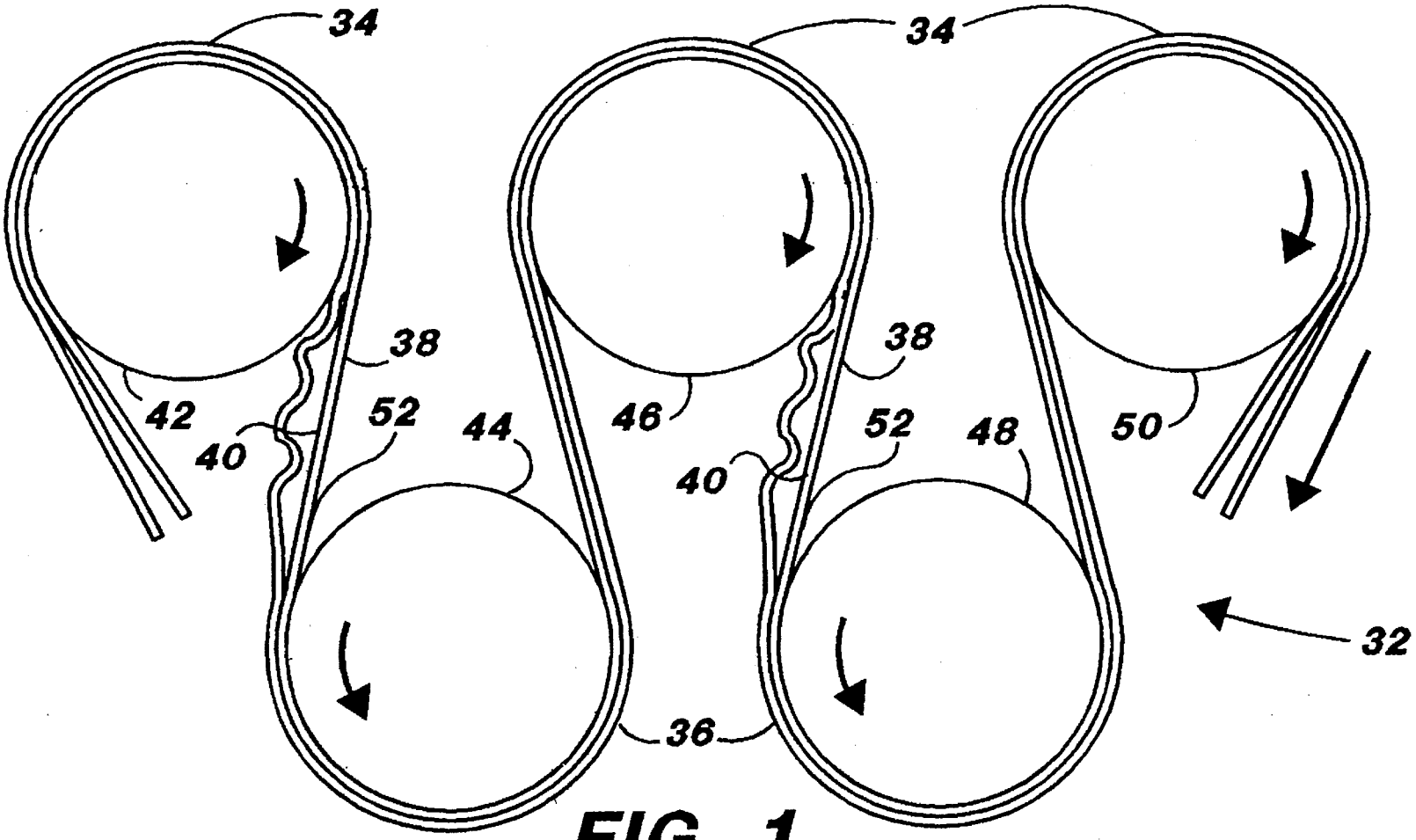
FIG. 1 (PRIOR ART)
FIG. 1 is a side-elevational view of a prior art two tier continuous single dryer-fabric dryer configuration.
Figure 2:
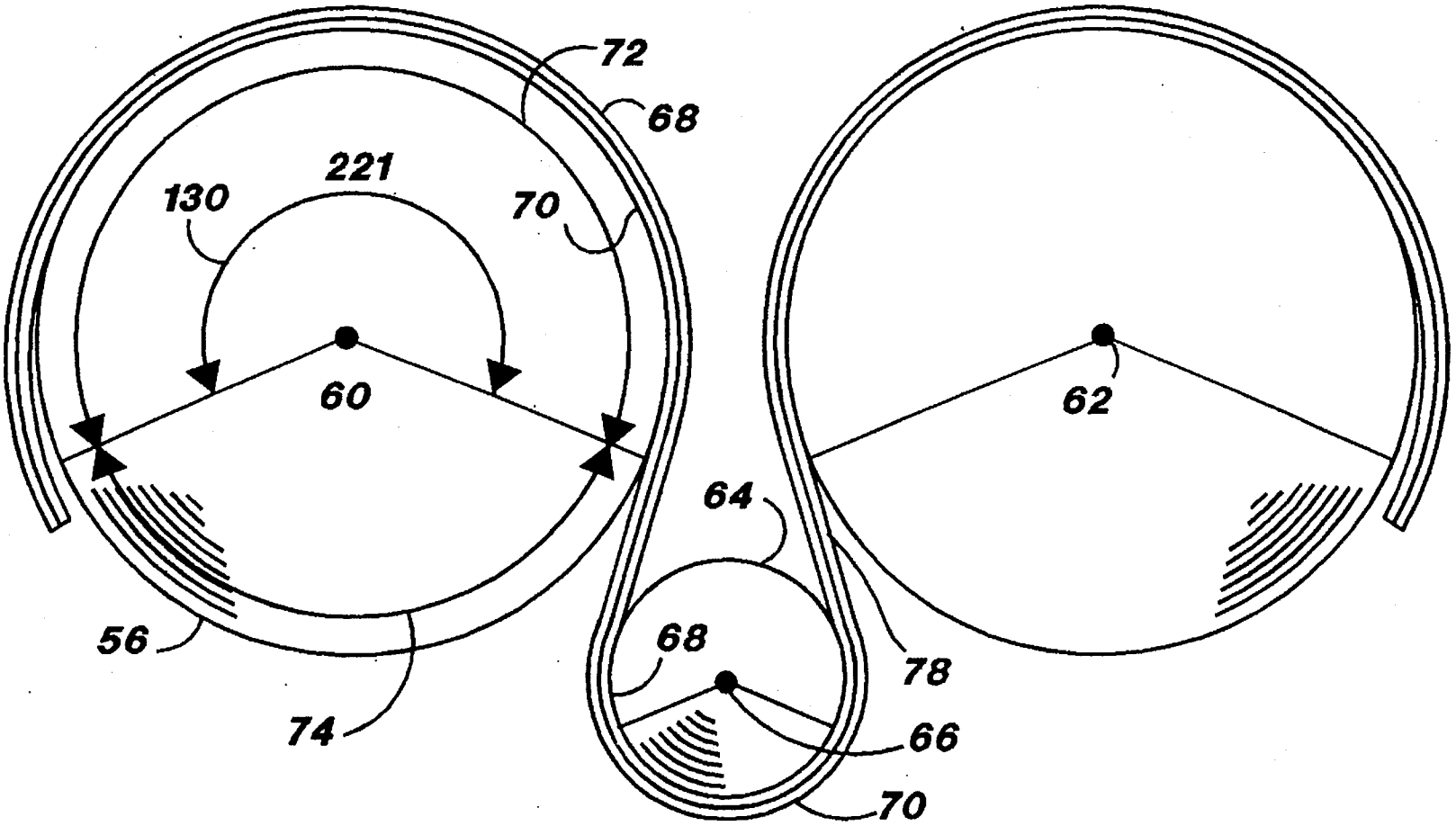
FIG. 2 (PRIOR ART)
FIG. 2 is a side-elevational view of a prior art single tier continuous dryer-fabric dryer configuration.
Figure 3:
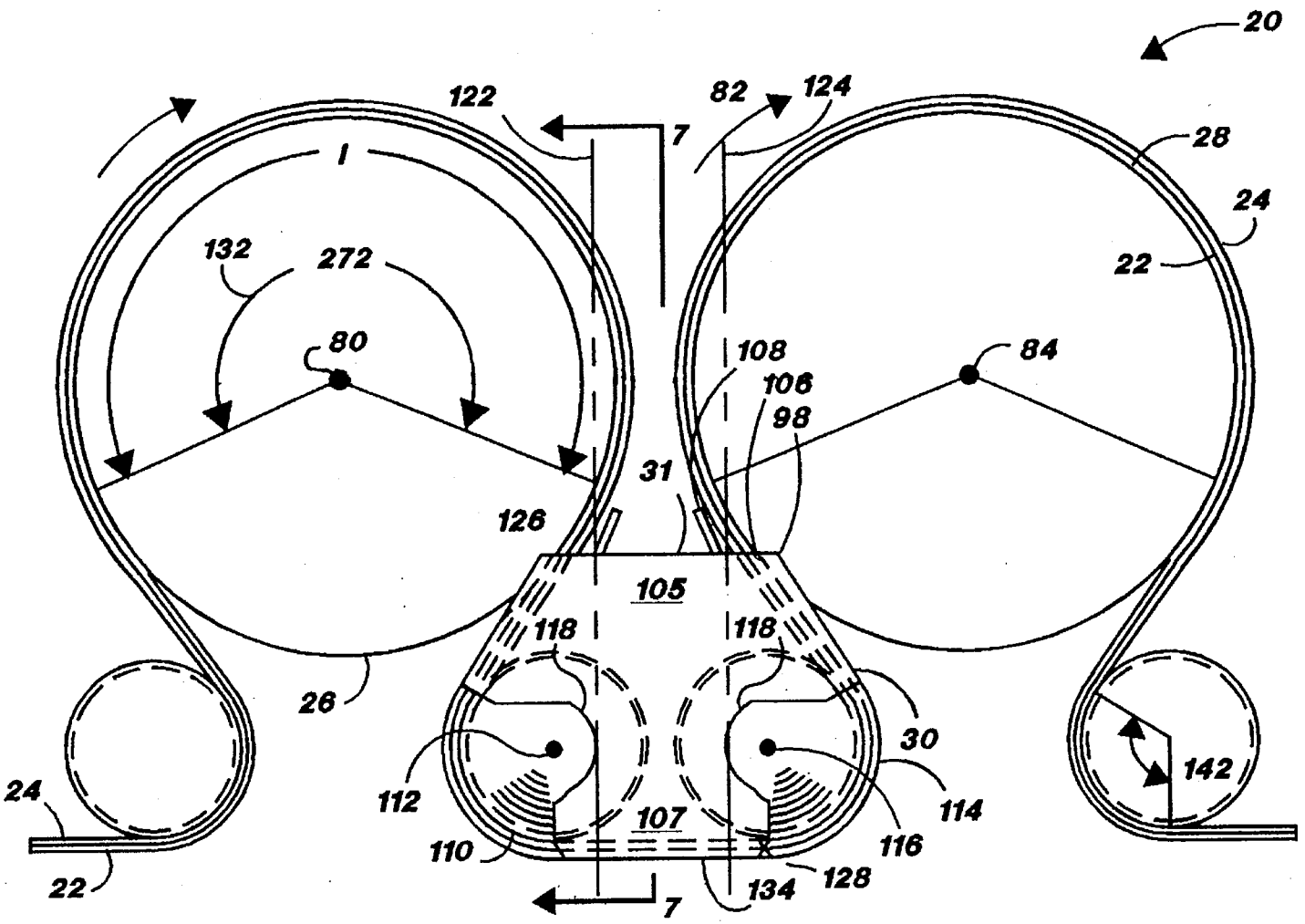
FIG. 3 is a side-elevational view of the paper drying apparatus of this invention with arrows indicating direction of rotation.
Figure 4:
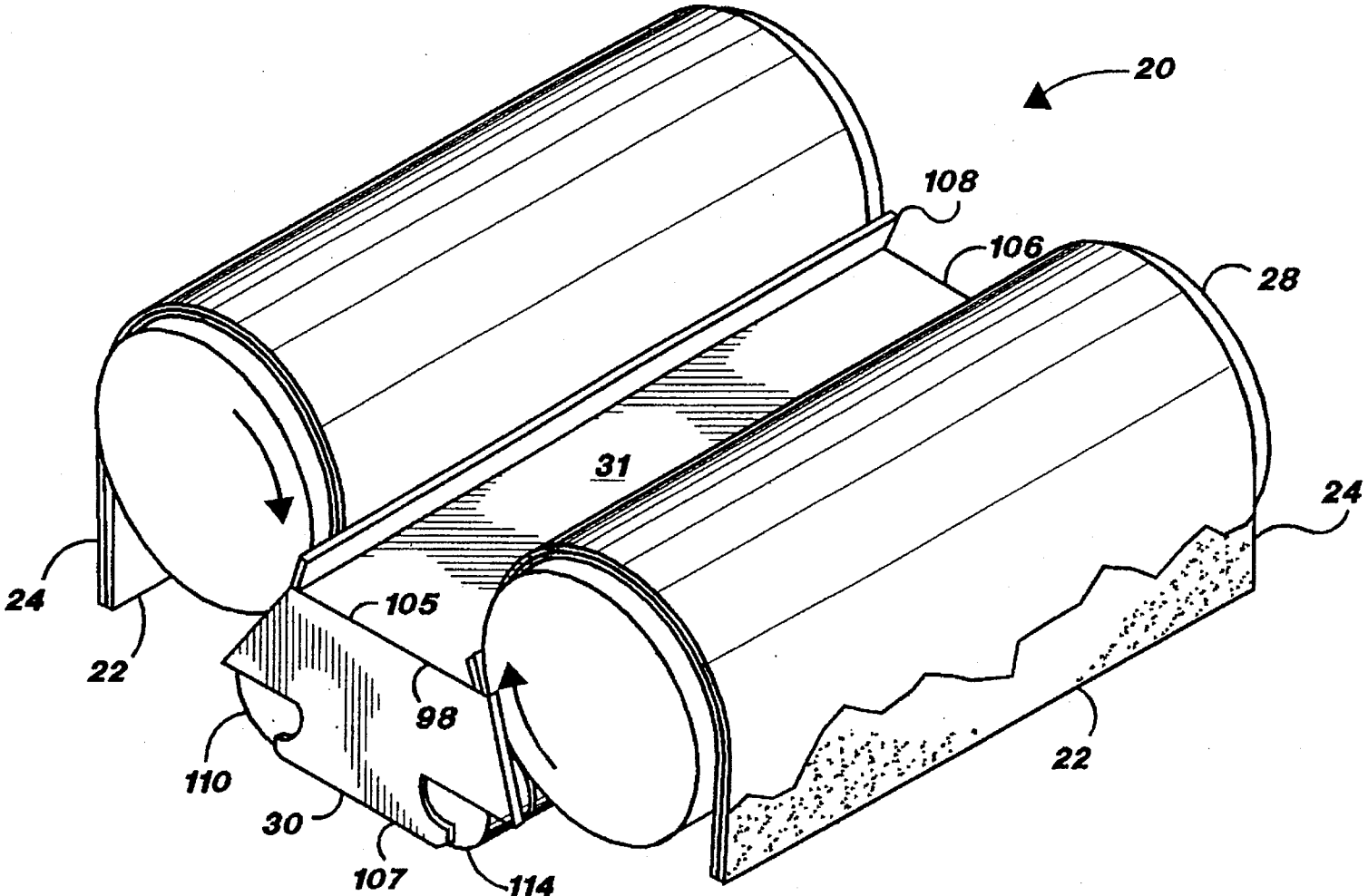
FIG. 4 is an isometric view of the apparatus of FIG. 3, with arrows indicating the direction of roll rotation.
Figure 5:
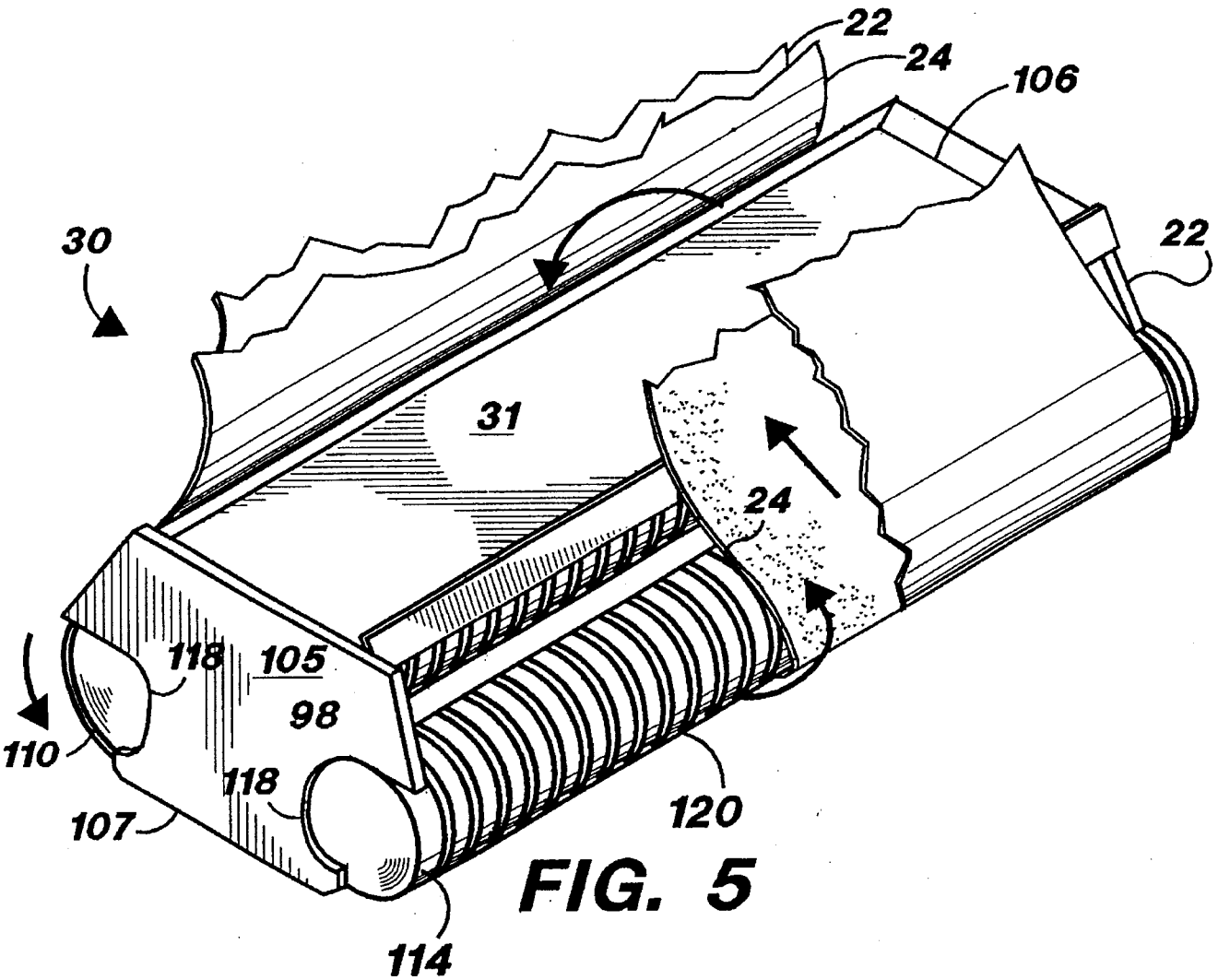
FIG. 5 is a fragmentary isometric view, with web partly broken away, of the paper drying apparatus of FIG. 3, showing the vacuum chamber transfer rolls enclosed therein.

Referring more particularly to FIGS. 1–7, wherein like numbers refer to similar parts, a paper drying apparatus 20 is shown in FIGS. 3–4. The paper drying apparatus 20 dries a continuous web 22 of wet paper formed during an earlier stage of the papermaking process through the use of a rapidly moving forming wire (not shown). The web 22 of wet paper is transferred from the forming wire after the former, through a press, and thence to a dryer fabric 24 which conveys the web 22 over a first dryer roll 26, under two reversing rolls 110, 114 within a vacuum chamber 30, and over a second dryer roll 28 in a serpentine configuration. The dryer rolls 26, 28 are internally steam heated and dry the web 22 to the desired moisture content. The reversing rolls 110, 114 are preferably grooved.

A prior art two tier continuous single dryer-fabric dryer 32 is shown in FIG. 1. The single dryer-fabric dryer 32 has a tier of upper dryer rolls 34 and a tier of lower dryer rolls 36. In operation, a dryer fabric 38 conveying a contiguous paper web 40 wraps around a first upper dryer roll 42 with the paper web 40 beneath the dryer fabric 38 and in contact with the first upper dryer roll 42. From the first upper dryer roll 42, the dryer fabric 38 extends downward and wraps around a first lower dryer roll 44 in such a manner that the dryer fabric is confined between the paper web 40 and the first lower dryer roll 44. After wrapping around the first lower dryer roll 44, the dryer fabric 38 extends upward and wraps around a second upper dryer roll 46 with the paper web 40 located beneath the dryer fabric 38 and in contact with the second upper dryer roll 46. Thereafter, the dryer fabric 38 and contiguous paper web 40 consecutively extend to and wrap around a second lower dryer roll 48 and a third upper dryer roll 50 in the same serpentine manner described above.

Because the dryer fabric 38 is located between the paper web 40 and the lower dryer rolls 44, 48 the dryer fabric 38 insulates heat transfer from the rolls 44, 48 and reduces the drying efficiency of the lower dryer rolls 44, 48. Also, the rapidly moving dryer fabric 38 may cause a buildup of air pressure at nip points 52, adjacent to where the dryer fabric 38 initially contacts the lower dryer rolls 44, 48. This localized air pressure forces the paper web 40 to separate from the dryer fabric 38 causing wrinkling and, in extreme cases, breakage, of the web 40.

A prior art single tier continuous dryer fabric dryer configuration 54 is shown in FIG. 2. The configuration 54 has a first dryer roll 56 spaced from a second dryer roll 58. The first dryer roll 56 is rotatably mounted lengthwise about a first central axis 60. The second dryer roll 58 is rotatably mounted lengthwise about a second central axis 62. The first central axis 60 and the second central axis 62 are parallel and are located in the same horizontal plane. A vacuum roll 64 is rotatably mounted lengthwise about a third central axis 66. The vacuum roll 64 is parallel to the dryer rolls 56, 58 and is centered in the paper travel direction between the first central axis 60 and the second central axis 62. A dryer fabric 68 conveying a contiguous paper web 70 is transferred in a serpentine route over the first dryer roll 56, under the vacuum roll 64 and over the second dryer roll 58.

Because the vacuum roll 64 is centered between the dryer rolls 56, 58 the configuration 54 does not maximize the drying potential of the dryer rolls 56, 58. The arrow 72 indicates the angle of wrap of the web about the dryer roll in a single vacuum roll configuration 54. The arrow 74 indicates the angle of wrap which is left unused by the configuration 54.

Another characteristic of the single vacuum roll configuration 54 is that the position of the vacuum roll 64 creates a short first open draw 76 and a short second open draw 78 located between the first dryer roll 56 and the vacuum roll 64 and between the vacuum roll 64 and the second dryer roll 58, respectively. Because the open draws 76, 78 have limited surface area and limited accessibility, the use of air caps to enhance drying is not feasible.

The paper drying apparatus 20 of the present invention, shown in FIG. 3, provides for a greater angle of wrap than the prior art dryer 54 in a single tier configuration. The drying apparatus 20 has a first cylindrical dryer roll 26 which is rotatably mounted about a first central axis 80. Separated from the first dryer roll 26 by an open gap 82 is a second cylindrical dryer roll 28 which is rotatably mounted about a second central axis 84. The first central axis 80 and the second central axis 84 are parallel and are located within the same generally horizontal plane. Both the first dryer roll 26 and the second dryer roll 28 are heated internally by steam supplied by an external source.

Figure 6:
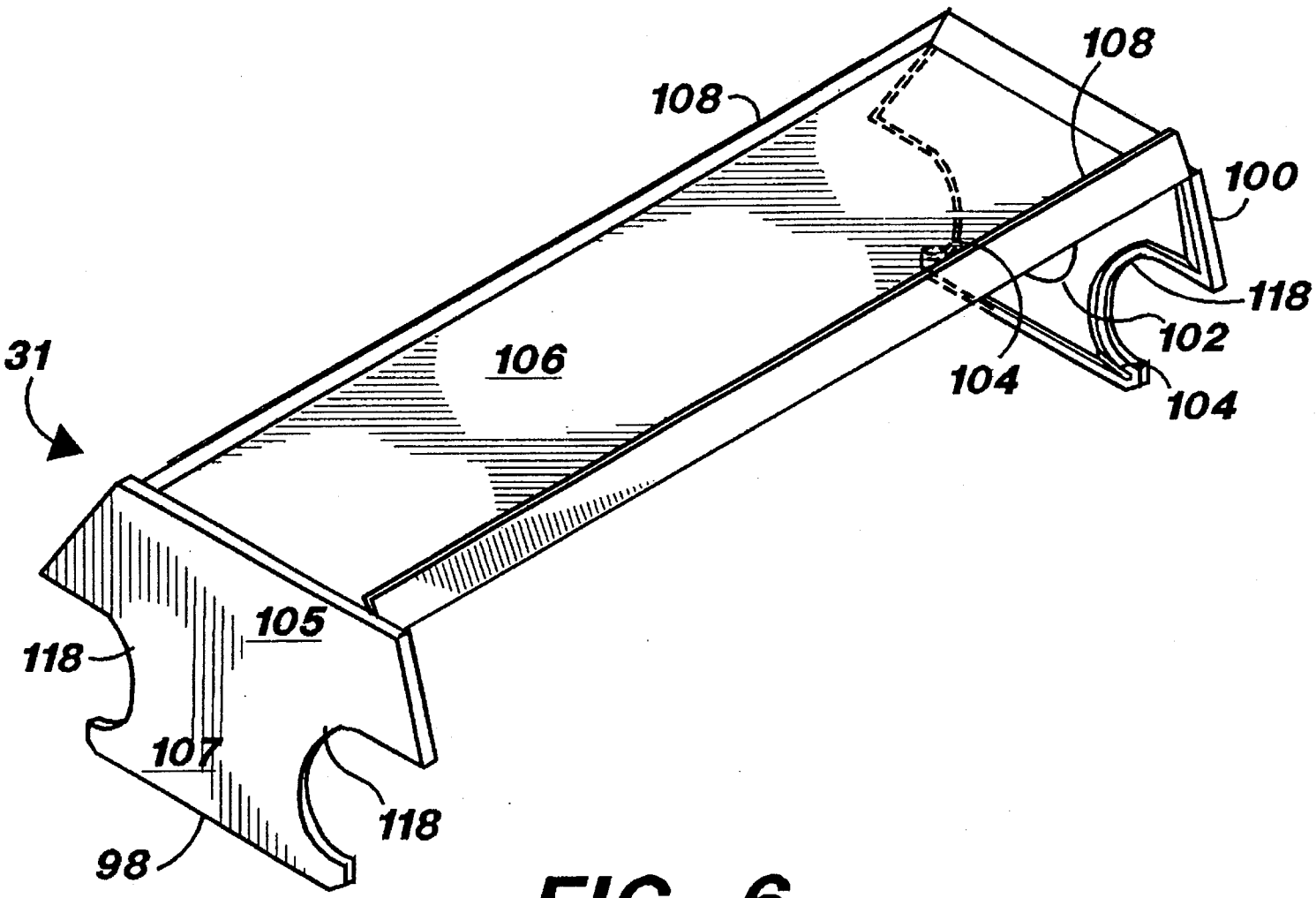
FIG. 6 is an isometric view of the vacuum chamber of FIG. 5.

A vacuum chamber 30 is formed by a rigid metal structure located beneath the gap 82 between the first dryer roll 26 and the second dryer roll 28. As shown in FIG. 6, the vacuum chamber 30 is formed by a metal cover 31 which is sealed against the moving dryer fabric 24 to define an internal volume on which reduced pressure is drawn. The cover 31 is comprised of two side plates 98, 100, which are joined by a top plate 106. Each side plate 98, 100, has two clearance openings 118 which are smaller in diameter than the grooved reversing rolls 110, 114 which are rotatably mounted within the vacuum chamber 30. The openings 118 provide clearance for the sideward extension of the shafts (not shown) on which the rolls 110, 114 are mounted. The side plates 98, 100 oppose each other and are perpendicular to the central axes 80, 84 of the dryer rolls. A hole 102 is cut through the side plate 100 which allows for the drawing of a vacuum on the vacuum chamber 30 by an external vacuum means (not shown). Each side plate 98, 100, has an upper segment 105 which extends above the grooved rolls 110, 114, and a downwardly extending tab 107 which blocks escape of air to the sides of the grooved rolls. A lower horizontal edge 103 of the tab 107 engages with the dryer fabric 24 as it passes between the two grooved rolls 110, 114. Stiffening ribs 104 project inwardly from the interior perimeter of the side plates 98, 100 to prevent excessive deflection of the plates by application of the vacuum.

Two inclined flanges 108 extend from the top plate 106 between the side plates 98, 100. Each inclined flange 108 extends upward from the top plate 106 and inward toward the center of the top plate 106 thereby forming an acute angle with the top plate 106.

As shown in FIG. 3, the first grooved roll 110 is rotatably mounted within the vacuum chamber 30 about a first roll axis 112. The second grooved roll 114 is rotatably mounted about a second roll axis 116. The first roll axis 112 and the second roll axis 116 are parallel to the central axes 80, 84 of the dryer rolls. A plurality of circumferential grooves 120 are spaced uniformly along the length of the grooved rolls 110, 114. The grooves 120 permit a vacuum to be drawn from the surfaces of the rolls 110, 114 which are engaged with the dryer fabric 24 by applying a vacuum to the exposed roll surfaces within the vacuum chamber 30.

As shown in FIG. 3, the first roll axis 112 is aligned frontwardly of a first vertical plane 122 which is tangent to the first dryer roll 26. The second roll axis 116 is aligned rearwardly of a second vertical plane 124 which is tangent to the second dryer roll 28.

Figure 7:
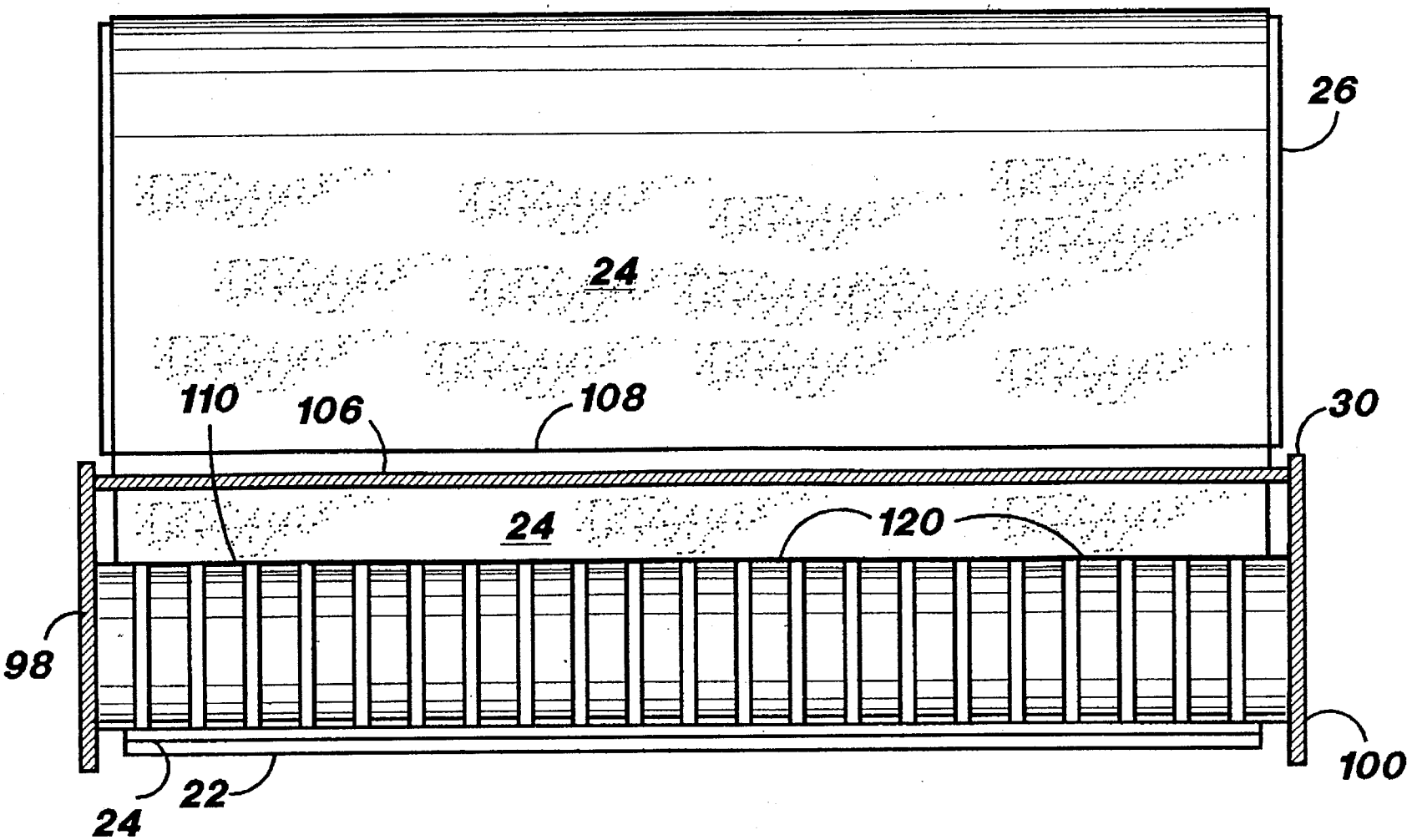
FIG. 7 is a cross-sectional view of the apparatus of FIG. 3 taken along section line 7—7.

As shown in FIGS. 3, and 7, the vacuum chamber bottom is enclosed by a dryer fabric 24 conveying a contiguous paper web 22. The dryer fabric 24 and paper web 22 wrap around the first grooved roll 110, extend across the vacuum chamber bottom and then wrap around the second grooved roll 114 thereby sealing the vacuum chamber bottom.

In operation, as shown in FIGS. 3 and 4, the continuous dryer fabric 24 and web 22 wrap around the first dryer roll 26 with the paper web 22 engaged against the heated surface of the dryer roll 26 and backed by the dryer fabric 24. The dryer fabric 24 and web 22 extend downwardly and frontwardly from the first dryer roll to wrap around the first grooved roll 110. As the dryer fabric 24 and web 22 extend downward, the dryer fabric 24 comes in close proximity to the inclined flange 108 which extends from the cover 31 and forms a seal with it. The dryer fabric 24 is traveling at high speeds as it engages the first grooved roll 110, and will tend to carry with it a quantity of air resulting in a localized region of high pressure. The vacuum chamber 30, however, draws away the air on the dryer fabric between the front flange 108 and the line of initial contact or first nip 126. Furthermore, at the first nip 126, the air is drawn from the grooves in the first grooved roll 110. By removing this air from the dryer fabric, fluttering of the web is prevented. The dryer fabric 24 and web 22 extend between the first grooved roll 110 and the second grooved roll 114 along the lower horizontal edge 103 of the cover 31. The low pressure region created in the vacuum chamber 30 draws the dryer fabric and web upwardly, and prevents fluttering of the web across this draw 134.

Localized pressure caused by the rapidly moving dryer fabric 24 at a second nip point 128 where the dryer fabric 24 initially contacts the second roll 114 is released through the circumferential grooves 120 in the second roll 114 with the aid of the vacuum means within the vacuum chamber 30. The dryer fabric 24 and web 22 extend upwardly and frontwardly from the second grooved roll 114. The dryer fabric 24 comes in close proximity to the inclined flange 108 on the rear of the cover top plate 106, thereby sealing the rear edge of the vacuum chamber 30. Finally the dryer fabric 24 and web 22 wrap around the second dryer roll 28 with the web 22 between the dryer fabric 24 and the second dryer roll 28.

Typically, the dryer fabric and web will proceed from the second dryer roll 28 to another pair of dryer rolls and a vacuum chamber, where the process will be repeated until the paper has achieved the desired level of dryness.

The use of two grooved rolls 110, 114, with the first grooved roll axis 112 located to the left of the first vertical plane 122 tangent to the first dryer roll 26, and the second grooved roll axis 116 located to the right of the second vertical plane 124 tangent to the second dryer roll 28, causes the web 22 to contact a larger portion of each dryer roll 26, 28 than would be possible through the use of a single roll. In other words, the distance between the grooved rolls is greater than the distance between the dryer rolls, such that the paper and dryer fabric are wrapped onto portions of the dryer rolls below a plane which passes through the axes of the dryer rolls. For example, a comparison of FIG. 2 and FIG. 3 shows that the two-roll design 20 uses a larger portion of the each dryer roll 26, 28. In FIG. 2, the single tier continuous dryer-fabric dryer roll 54 with a 24-inch vacuum roll 64 and 72-inch dryer rolls 56, 58 obtains an angle of wrap equal to 221 degrees as shown by arrow 130. In comparison, FIG. 3 shows that the paper drying apparatus 20 of this invention, with 84-inch dryer rolls 26, 28 and 32-inch grooved rolls 110, 114, obtains an angle of wrap equal to 272 degrees as shown by arrow 132.

By making more efficient use of dryer rolls, the length of the entire drying apparatus is reduced. The increase in efficiency and decrease in machine length is even more apparent when the two-roll configuration 20 of this invention is used in combination with larger dryer roll sizes. For example, modeling indicates that a conventional single tier dryer configuration 54 as shown in FIG. 2 with six-foot diameter dryer rolls requires 30 dryer rolls and a length of 195 feet in order to dry the web 70 to the desired moisture content. In contrast, the two-grooved-transfer-roll design 20 as shown in FIG. 3, when utilized with eight-foot diameter dryer rolls, requires 20 dryer rolls and 170 feet in length in order to dry the web 22 to the desired moisture content. Besides the reduction in length, the dryer configuration 20 reduces initial capital expenditures for construction by requiring fewer dryer rolls.

In addition to the cost benefits of fewer dryer rolls, significant cost advantages are realized in the utilization of a single vacuum chamber in preference to one or more vacuum rolls. Vacuum rolls, which require a multiplicity of drilled holes in the roll surface to provide air channels, are much more costly to fabricate than a grooved roll. The present invention provides a single tier dryer installation with no unsupported draws and without the need for any vacuum rolls.

The two-roll configuration 20 creates a length of draw 134 between the two rolls 110, 114. The length of draw 134 allows for the easy installation of air caps (not shown) which blow hot air through the web 22. The use of air caps increases vapor flashing thereby increasing drying rates.

The vacuum chamber 30 provides restraint to the web 22 and controls all air flow in the gap 82 between the first dryer roll 26 and the second dryer roll 28. By controlling air flow in the gap 82, sheet flutter of the web 22 is eliminated and greater running speeds are obtainable. Additionally, because the vacuum chamber 30 controls air flow in the gap 82, high permeability blanket dryer fabric can be utilized to enhance drying rates when used in combination with air caps.

It should be understood that the assembly of dryer rolls and vacuum chamber may be provided within an extended line of dryer rolls, and that dryers having different dimension rolls may also be formed.

It should also be understood that the diameter of the dryer rolls may be varied. Further the diameter of the reversing rolls may be varied. Additionally other types of rolls may be substituted for the grooved reversing rolls. The dryer apparatus may also employ blind-drilled rolls, plain rolls, perforated rolls, or a combination of roll types.

Furthermore, although the grooved rolls have been illustrated and described as being positioned below the dryer rolls, it should be understood that the paper web as it progresses through the dryer section of a papermaking machine will alternatively be wrapped around upper dryer rolls to dry one side of the web, and lower dryer rolls, to dry the other side of the web. Hence in some cases the grooved rolls will be positioned above the dryer rolls, and the vacuum chamber thus beneath the paper web.

It is understood that the invention is not confined to the particular construction and arrangement of parts herein illustrated and described, but embraces all such modified forms thereof as come within the scope of the following claims.

I claim:

1. An apparatus for drying a paper web supported by a dryer fabric as part of a paper manufacturing process, the apparatus comprising:

a first rotatable cylindrical dryer roll;

a second rotatable cylindrical dryer roll spaced from the first dryer roll;

a first reversing roll rotatably mounted after the first dryer roll; a second reversing roll rotatably mounted after the first reversing roll and before the second dryer roll;

a cover positioned between the first dryer roll and the second dryer roll, wherein the cover overlies the reversing rolls, and wherein the dryer fabric and web travel over the first dryer roll and are engaged with the first reversing roll at a position adjacent the cover, and the dryer fabric and web pass from the first reversing roll to the second reversing roll and from the second reversing roll to the second dryer roll; and a means for drawing air from the cover to define a region of reduced pressure defined by the cover, the reversing rolls, and the dryer fabric and web.

2. The apparatus of claim 1 wherein the cover has a top plate which overlies the reversing dryer rolls, and two side plates which extends from the top plate to prevent air passage outwardly and sidewardly of the reversing rolls.

3. The apparatus of claim 1 further comprising:

a first flange which extends from the cover top plate and toward the first roll; and a second flange which extends from the cover top plate and toward the second roll, wherein the flanges lie adjacent the dryer fabric as it extends toward the first reversing roll and from the second reversing roll toward the second dryer.

4. The apparatus of claim 1 wherein a first vertical plane is defined tangent to the first dryer roll between the first dryer roll and the second dryer roll, and a vertical plane is defined tangent to the second dryer roll between the first dryer roll and the second dryer roll, and wherein the first reversing roll has an axis of rotation which is frontward of the first plane, and the second reversing roll has an axis of rotation which is rearward of the second plane.

5. A paper web drying apparatus comprising:

a first dryer roll rotatable about an axis;

a second dryer roll rotatable about an axis and spaced rearwardly from the first dryer roll;

a first reversing roll rotatable about an axis and a second reversing roll rotatable about an axis, wherein the reversing roll axes are spaced vertically from the dryer roll axes, and the reversing rolls are positioned between the first dryer roll and the second dryer roll;

a vacuum chamber surrounding portions of the reversing rolls and between the dryer rolls, wherein the vacuum chamber has a top plate spaced from the reversing rolls, and two side plates positioned sidewardly of the reversing rolls;

a means for removing air from the vacuum chamber; and a dryer fabric which extends around a portion of the first dryer roll onto the first reversing roll to the second reversing roll, and thence to the second dryer roll, wherein the dryer fabric obstructs entry of air into the vacuum chamber, such that the means for removing air may draw air from the vacuum chamber to hold the dryer fabric engaged with the reversing rolls and reduce flutter of the dryer fabric and a paper web supported on the dryer fabric.

6. The apparatus of claim 5 further comprising a second apparatus of claim 5, wherein the dryer fabric of the second dryer roll of the first apparatus comprises the first dryer roll of the second apparatus.

7. The apparatus of claim 5 further comprising flanges which extend upwardly from the vacuum chamber top plate, and wherein the flanges extend toward one another and are adjacent the dryer fabric as it enters and leaves the vacuum chamber.

8. The apparatus of claim 5 wherein the first dryer roll rotates about an axis, and wherein the second dryer roll rotates about an axis, and wherein the distance between the reversing rolls is greater than the distance between the dryer rolls, such that the paper and dryer fabric are wrapped onto portions of the dryer rolls below a plane which passes through both the axes of the first dryer roll and the second dryer roll.

9. An apparatus for drying a paper web supported by a dryer fabric as part of a paper manufacturing process, the apparatus comprising:

a first rotatable cylindrical dryer roll;

a second rotatable cylindrical dryer roll spaced from the first dryer roll;

a first grooved roll rotatably mounted after the first dryer roll;

a second grooved roll rotatably mounted after the first grooved roll and before the second dryer roll;

a cover positioned between the first dryer roll and the second dryer roll, wherein the cover overlies the grooved rolls, and wherein the dryer fabric and web travel over the first dryer roll and are engaged with the first grooved roll at a position adjacent the cover, and the dryer fabric and web pass from the first grooved roll to the second grooved roll and from the second grooved roll to the second dryer roll; and a means for drawing air from the cover to define a region of reduced pressure defined by the cover, the grooved rolls, and the dryer fabric and web.

10. The apparatus of claim 9 wherein the cover has a top plate which overlies the grooved dryer rolls, and two side plates which extend from the top plate to prevent air passage away from the web and sidewardly of the grooved rolls.

11. The apparatus of claim 9 further comprising:

a first flange which extends from the cover top plate and toward the first roll; and a second flange which extends from the cover top plate and toward the second roll, wherein the flanges lie adjacent the dryer fabric as it extends toward the first grooved roll and from the second grooved roll toward the second dryer.

12. The apparatus of claim 9 wherein a first vertical plane is defined tangent to the first dryer roll between the first dryer roll and the second dryer roll, and a vertical plane is defined tangent to the second dryer roll between the first dryer roll and the second dryer roll, and wherein the first grooved roll has an axis of rotation which is frontward of the first plane, and the second grooved roll has an axis of rotation which is rearward of the second plane.

* * * * *